US007397487B2

(12) United States Patent
Fukui

(10) Patent No.: US 7,397,487 B2
(45) Date of Patent: Jul. 8, 2008

(54) IMAGE FORMING APPARATUS

(75) Inventor: Takashi Fukui, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 384 days.

(21) Appl. No.: 11/231,821

(22) Filed: Sep. 22, 2005

(65) Prior Publication Data

US 2006/0066710 A1 Mar. 30, 2006

(30) Foreign Application Priority Data

Sep. 29, 2004 (JP) ..... 2004-284640

(51) Int. Cl.
*B41J 11/00* (2006.01)

(52) U.S. Cl. ..... 347/139; 347/218; 347/104; 347/262; 347/264

(58) Field of Classification Search ..... 347/104, 347/139, 218, 262, 264
See application file for complete search history.

(56) References Cited

U.S. PATENT DOCUMENTS 4,617,470 A * 10/1986 Horikawa ..... 250/559.36
5,057,861 A * 10/1991 Maeda et al. ..... 355/402
5,934,167 A * 8/1999 Yamamoto ..... 83/650
7,255,412 B2 * 8/2007 Nagashima ..... 347/15

FOREIGN PATENT DOCUMENTS

JP A 2000-235267 8/2000

* cited by examiner

*Primary Examiner*—Huan H Tran
(74) *Attorney, Agent, or Firm*—Margaret A. Burke; Sheldon J. Moss

(57) ABSTRACT

An image forming apparatus that forms images, while continuously conveying, a long flexible recording medium in a constant conveyance direction on a conveyance path, the image forming apparatus comprising: a belt conveyance mechanism that is disposed on the conveyance path and is configured by an endless belt wound between at least two rollers; and an image forming unit that conducts image forming on the long flexible recording medium being conveyed in a state where the long flexible recording medium is flatly disposed on the endless belt of the belt conveyance mechanism disposed on the conveyance path.

13 Claims, 8 Drawing Sheets

IMAGE FORMING APPARATUS

CROSS-REFERENCE TO RELATED APPLICATION

This application claims priority under 35 USC 119 from Japanese Patent Application No. 2004-284640, the disclosure of which is incorporated by reference herein.

BACKGROUND OF THE INVENTION

1. Field of the Invention

The present invention relates to an image forming apparatus that forms an image on a long flexible recording medium.

2. Description of the Related Art

Among commonly used image forming apparatus, there are exposure apparatus, such as scanning type printed board exposure apparatus, laser photoplotters and laser printers, that form a desired image on a recording medium by scanning the recording medium with a light beam.

In such exposure apparatus, in the case of a printed board exposure apparatus, for example, image forming is conducted by scanning, with laser light, a board material for a printed wiring board that is a recording medium. The board material for the printed wiring board used here is made by forming a thin film conductor on an insulating layer and covering the thin film conductor with a photoresist.

The printed board exposure apparatus exposes a desired board pattern on the photoresist layer by scanning the board material with laser light modulated on the basis of image data.

The exposed board material for the printed wiring board is removed from the printed board exposure apparatus and photo-etched, whereby a printed board is completed.

In conventional printed board exposure apparatus used in this manner, a long, band-like recording medium in a sheet roll is stretched between a loader, which feeds the recording medium, and an unloader, which collects the recording medium. The stretched portion of the recording medium is placed and fixed on an image forming surface of an image forming table by fixing means (a mechanism), and the image forming table is configured to be slidable with high precision by sliding means (a mechanism). A scanning optical system that scans the recording medium with laser light is disposed directly above the recording medium stretched between the loader and the unloader.

The image forming table, on whose image forming surface the stretched portion of the recording medium is fixed by the fixing means, is conveyed with high precision by the sliding means. As the recording medium is slid with high precision together with the image forming table, the scanning optical system scans the recording medium with laser light modulated on the basis of image data, whereby image forming is conducted.

In such conventional printed board exposure apparatus, image forming is again started after the first image forming ends. Thus, the fixing means of the image forming table is released, the recording medium is fixed by a clamp roller pair of the loader and by a drive roller pair of the unloader so that the recording medium stretched between the loader and the unloader becomes immovable, and the image forming table is moved towards the loader by the sliding means. Next, the recording medium is fixed on the image forming surface of the image forming table by the fixing means of the image forming table. Next, the clamp roller pair of the loader is opened and the recording medium is reeled out by a reel roller pair of the loader to form slack. Next, the image forming table is moved towards the unloader by the sliding means, the recording medium fixed on the image forming surface of the image forming table is scanned by the scanning optical system, the recording medium is collected inside the unloader by the drive roller pair of the unloader, and the next image forming ends. When the next image forming is to be conducted, the above operation is repeated the necessary number of times (e.g., see Japanese Patent Application Laid-Open Publication (JP-A) No. 2000-235267).

In such conventional printed board exposure apparatus, from when image forming ends to until the next image forming starts, the next image forming operation cannot begin until the operation of releasing the fixing means of the image forming table, fixing the recording medium with the loader and the unloader, moving the image forming table towards the loader with the sliding means, fixing the recording medium on the image forming surface of the image forming table with the fixing means of the image forming table, releasing the clamp roller pair of the loader, and reeling out the recording medium with the reel roller pair of the loader to form slack ends. For this reason, there may be a lot of waiting time outside the time in which exposure processing is being conducted.

SUMMARY OF THE INVENTION

A first aspect of the invention provides an image forming apparatus that forms images, while continuously conveying, a long flexible recording medium in a constant conveyance direction on a conveyance path, the image forming apparatus comprising: a belt conveyance mechanism that is disposed on the conveyance path and is configured by an endless belt wound between at least two rollers; and an image forming unit that conducts image forming on the long flexible recording medium being conveyed in a state where the long flexible recording medium is flatly disposed on the endless belt of the belt conveyance mechanism disposed on the conveyance path.

According to this configuration, the long flexible recording medium is conveyed in a state where it is flatly disposed on the endless belt of the belt conveyance mechanism. Image forming can be continuously conducted by the image forming unit on the portion of the long flexible recording medium that is flatly retained and conveyed on the endless belt. Thus, exposure processing can always be continued, whereby the waiting time can be reduced, many exposure process can be conducted in a short time, and productivity can be improved.

In the first aspect of the invention, the image forming apparatus may further comprise a suction mechanism disposed at a side of the endless belt opposite from the side of the endless belt on which the recording medium is placed.

Also, the endless belt may include through holes and the suction mechanism may conduct sucking through the through holes, whereby the long flexible recording medium is sucked against the surface of the endless belt.

By configuring the image forming apparatus in this manner, the long flexible recording medium is sucked against the surface of the endless belt that is wound and flatly stretched between the at least two rollers, whereby image forming can be conducted while the flatness of the flexible recording medium is maintained as the flexible recording medium is conveyed. Therefore, the stability of image forming can be improved.

Also, the belt conveyance mechanism may include a support mechanism that is disposed at the side of the endless belt opposite from the side of the endless belt on which the recording medium is placed and which supports the underside of the endless belt.

The support mechanism may comprise a contact roller.

Moreover, the support mechanism may comprise a suction stage including numerous suction-use holes.

By configuring the image forming apparatus in this manner, the contact roller or the suction stage supports the undersurface of the endless belt that is wound and flatly stretched between the at least two rollers, and the flatness of the flexible recording medium is maintained via the endless belt. For this reason, image forming can be conducted in a state where even greater flatness is retained. Therefore, the stability of image forming can be further improved.

Also, the image forming unit may comprise a laser exposure device.

Moreover, the image forming unit may be configured to modulate light beams with a spatial light modulator and expose a two-dimensional pattern.

The image forming apparatus may also further comprise an alignment unit, wherein the belt conveyance mechanism is movable to an alignment position at which an image forming position is corrected by the alignment unit and an image forming position resulting from the image forming unit.

The endless belt may comprise plural belts disposed at predetermined intervals apart from each other, and the alignment unit may be disposed opposite from the image forming unit via the endless belt and detect, through gaps between the plural belts, alignment marks formed on the undersurface of the flexible recording medium to conduct alignment.

DETAILED DESCRIPTION OF THE INVENTION

An embodiment of the image forming apparatus pertaining to the invention will now be described with reference to FIGS. 1 to 8.

The image forming apparatus pertaining to the embodiment of the invention is configured as an exposure apparatus that is automatically controlled by a control unit and conducts exposure processing with an exposure head by moving, in a main scanning direction, a flexible printed wiring board material that is a flexible recording medium formed in a long, band-like sheet, spatially modulating multi-beams emitted from light sources on the basis of modulation signals generated from image data by the control unit, and irradiating the flexible printed wiring board material with the spatially modulated multi-beams.

Figure 1:
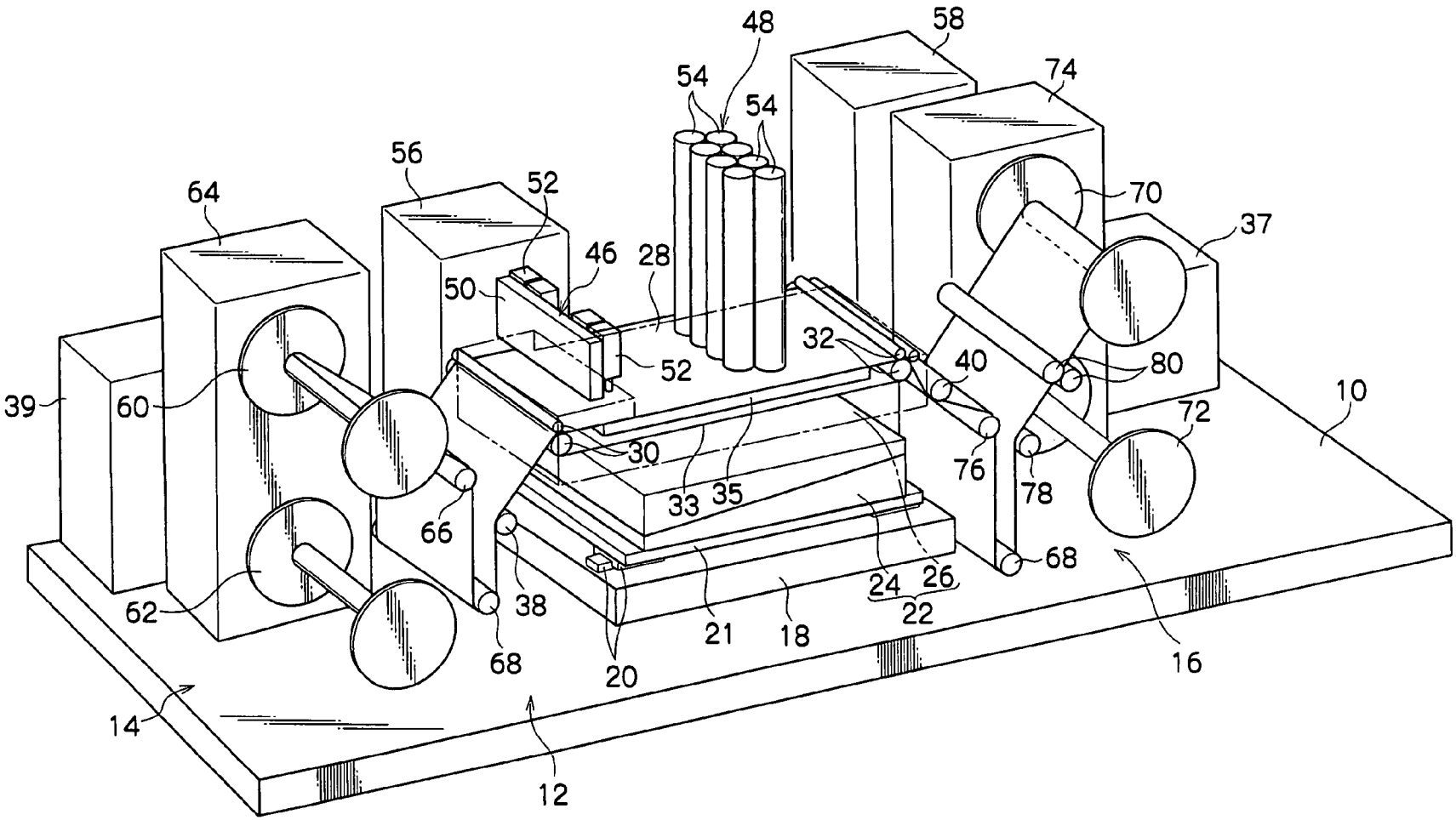
FIG. 1 is a perspective view showing the schematic configuration of relevant portions of an image forming apparatus pertaining to an embodiment of the invention.

As shown in FIG. 1, the image forming apparatus includes a floor base 10, an exposure processing section 12, an unexposed recording medium supply section 14, and an exposed recording medium collection section 16. The exposure processing section 12 is disposed in a center portion of the floor base 10, the unexposed recording medium supply section 14 is disposed at one side (the left side in FIG. 1) of the exposure processing section 12, and the exposed recording medium collection section 16 is disposed at the other side of the exposure processing section 12 (the right side in FIG. 1).

The exposure processing section 12 includes a board conveyance unit 22 that is mounted, via a linear movement mechanism 20, on a flat surface of a vibration-isolating device base 18 disposed on the floor base 10.

The linear movement mechanism 20 includes a linear motor or other feeding means mounted between the upper flat portion of the vibration-isolating device base 18 and a moving table 21 to which the board conveyance unit 22 is attached.

When the linear movement mechanism 20 is configured by a linear motor, for example, the vibration-isolating device base 18 is disposed with an unillustrated rod-like stator portion (magnetic portion) along the conveyance direction and an unillustrated coil portion disposed at the undersurface side of the moving table 21. The linear motor causes the moving table 21 to be moved in the conveyance direction by a drive force resulting from the action of a magnetic field generated by energizing the coil portion and a magnetic field of the stator portion.

The linear motor is configured to drive/control, with high precision and by electric control, the constant speed, positioning precision, and torque vibrations at the time of start and stop in the conveyance operation of the board conveyance mechanism 22.

Figure 2:
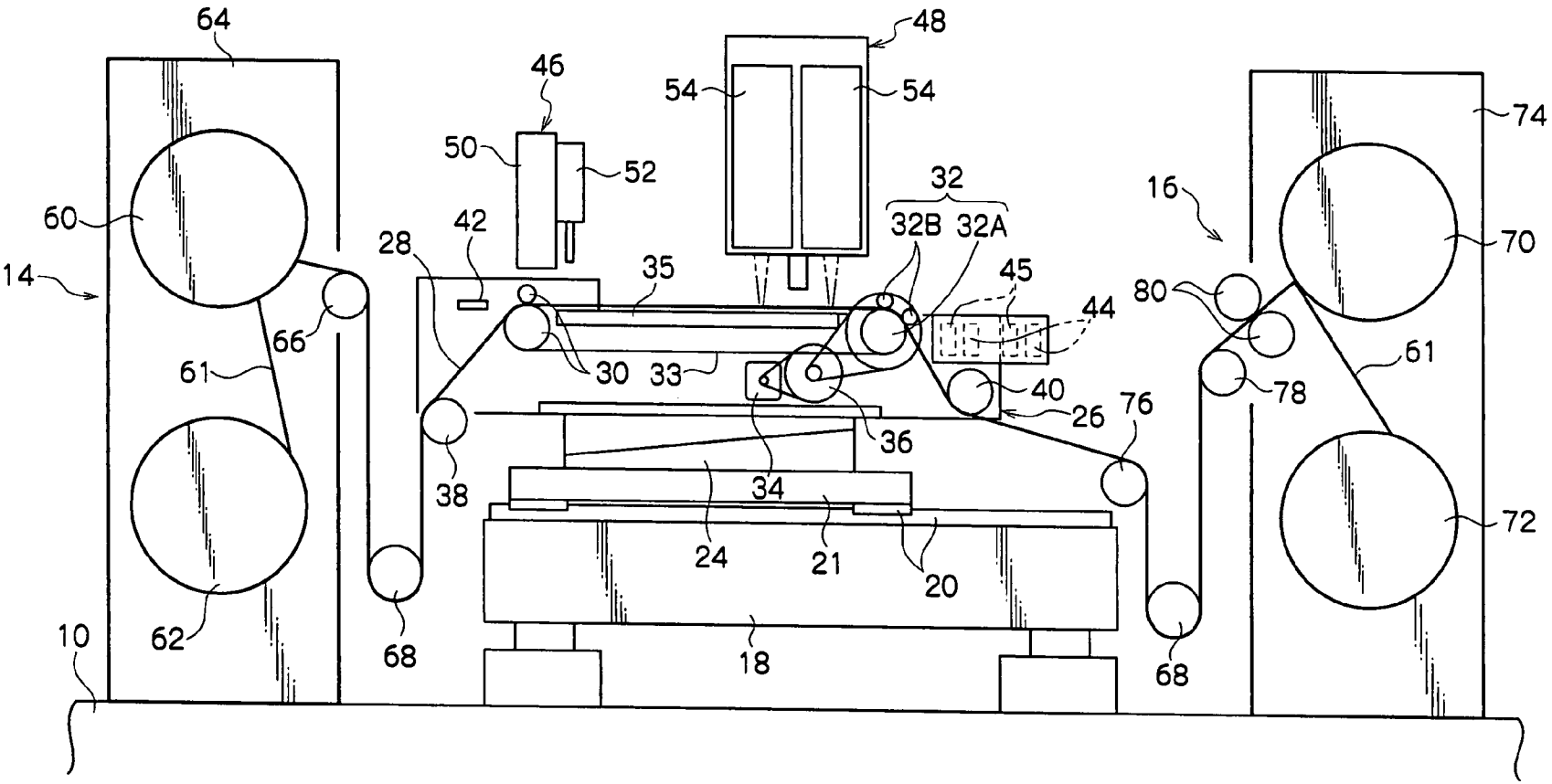
FIG. 2 is a front view showing the schematic configuration of relevant portions of the image forming apparatus pertaining to the embodiment of the invention.
Figure 3:
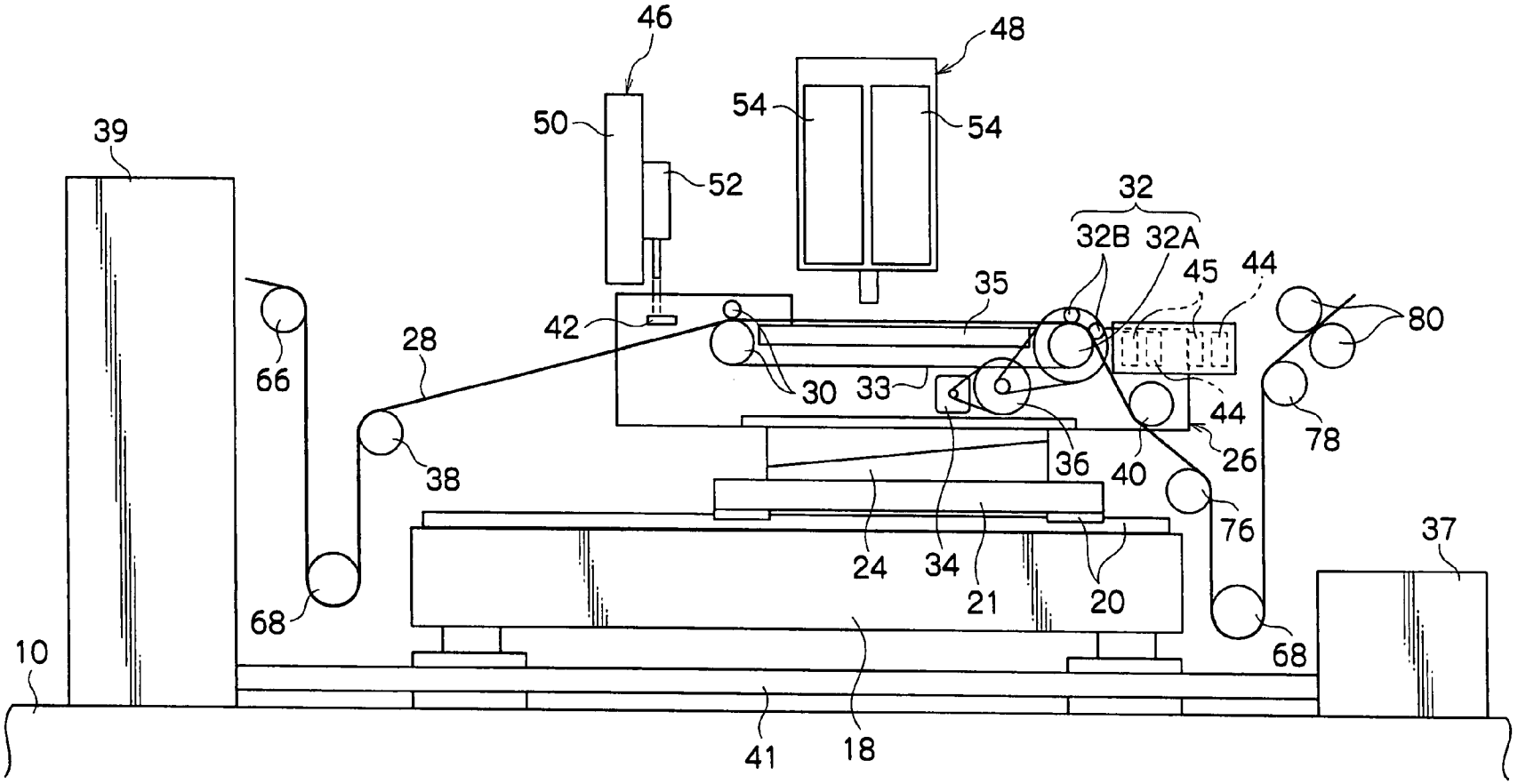
FIG. 3 is a schematic configural diagram showing a state where a detection unit-attached scan-use conveyance unit of the image forming apparatus pertaining to the embodiment of the invention is moved to a position for alignment camera correction.
Figure 4:
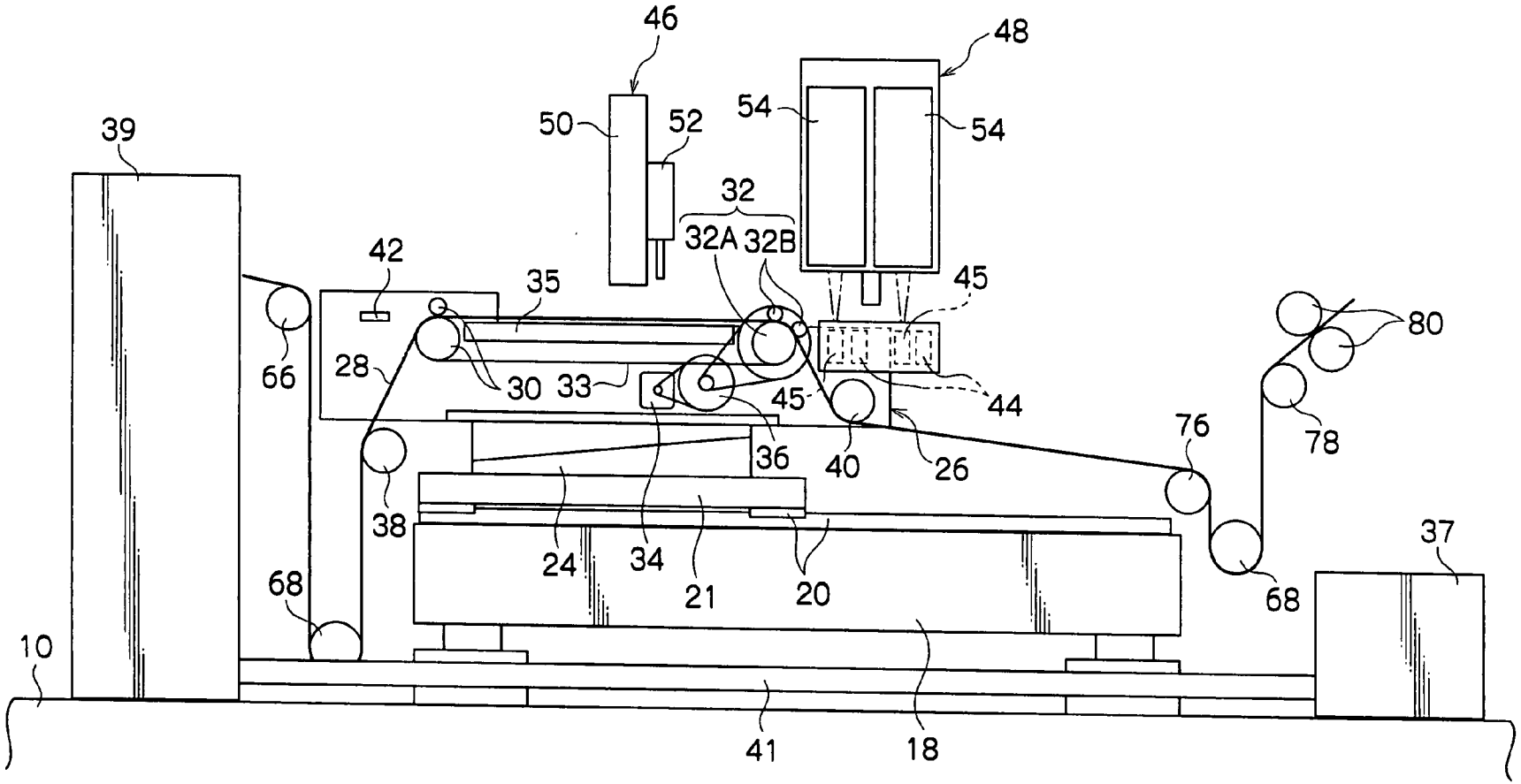
FIG. 4 is a schematic configural diagram showing a state where the detection unit-attached scan-use conveyance unit of the image forming apparatus pertaining to the embodiment of the invention is moved to a position for beam position detection.
Figure 5:
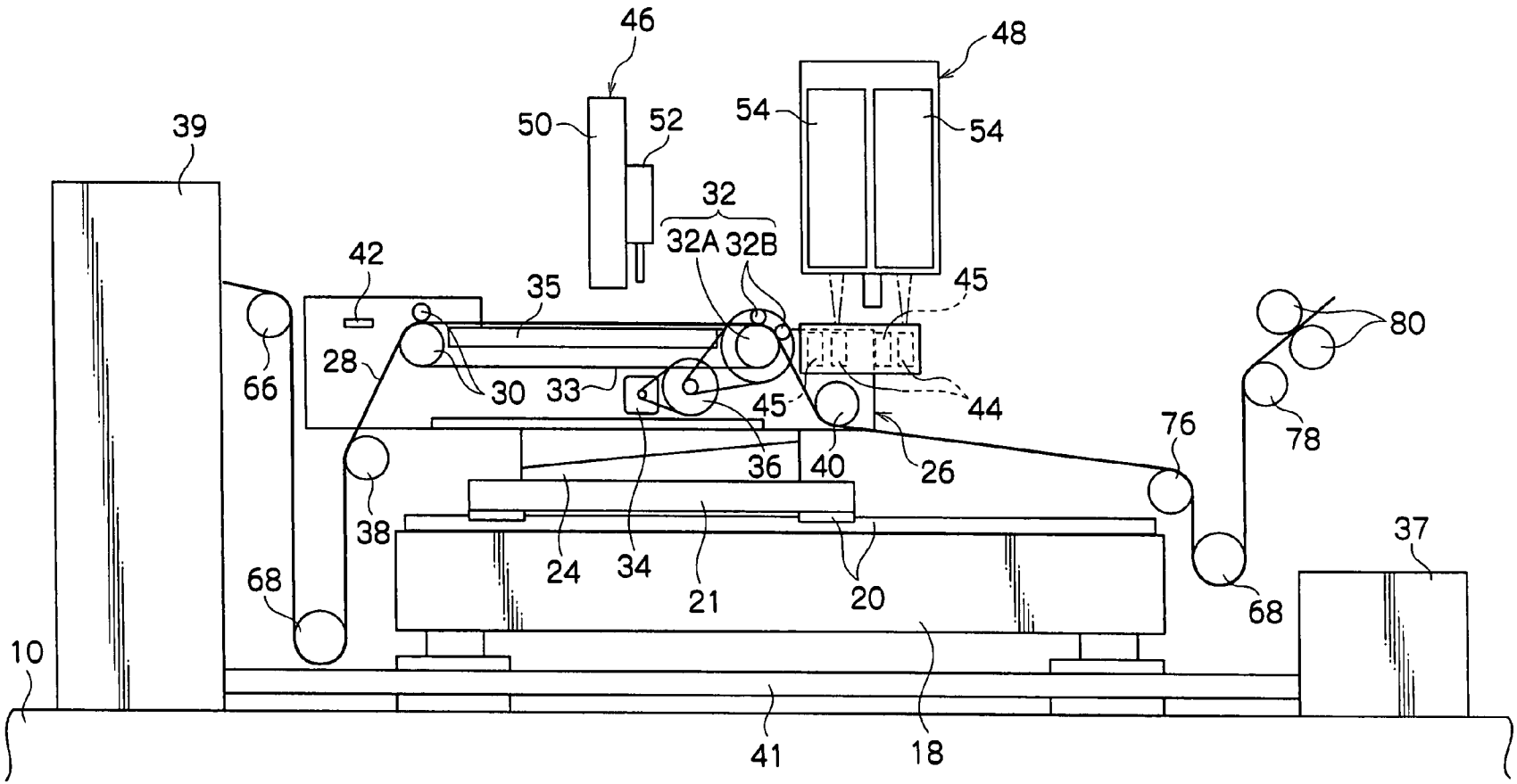
FIG. 5 is a schematic configural diagram showing a state where the detection unit-attached scan-use conveyance unit of the image forming apparatus pertaining to the embodiment of the invention is moved to a position for exposure surface power correction.

The linear movement mechanism 20 is configured to be movable from an exposure processing position shown in FIGS. 1 and 2 to a position for alignment camera correction in FIG. 3, a position for beam position correction shown in FIG. 4, and a position for exposure surface power correction shown in FIG. 5.

As shown in FIGS. 1 and 2, a board thickness adjustment-use Z stage 24 is disposed above the moving table 21 in the board conveyance unit 22, and a detection unit-attached scan-use conveyance unit 26 is disposed above the board thickness adjustment-use Z stage 24.

The board thickness adjustment-use Z stage 24 enables the entire detection unit-attached scan-use conveyance unit 26 to be moved parallel in the height direction (Z axis direction) with a fine movement adjustment mechanism using a slanted surface in order to adjust the height position of the recording medium exposure surface.

As shown in FIG. 2, a belt conveyor mechanism is mounted on the detection unit-attached scan-use conveyance unit 26 in order to convey a flexible printed wiring board material 28 that is a long flexible recording medium. The belt conveyor mechanism includes a nip roller pair 30 disposed at the upstream side in the conveyance direction, a nip drive roller pair 32 disposed at the downstream side in the conveyance direction, and an endless belt 33 that is wound between the nip roller pair 30 and the nip drive roller pair 32.

The nip drive roller pair 32 is configured by a drive roller 32A and plural (here, two) nip rollers 32B that contact the outer peripheral surface of the drive roller 32A via the endless belt 33. The flexible printed wiring board material 28 is inserted, via the endless belt 33, between the drive roller 32A and the nip rollers 32B. By rotating the drive roller 32A, the endless belt 33 and the flexible printed wiring board material 28 are conveyed without slipping.

A rotation drive force of a predetermined number of rotations outputted by a drive motor 34 and decelerated by a deceleration mechanism 36 is transmitted by a belt transmission mechanism to the drive roller 32A. Thus, the nip drive roller pair 32 conveys the flexible printed wiring board material 28 at a predetermined scanning speed.

The nip roller pair 30 disposed in the detection unit-attached scan-use conveyance unit 26 is configured by two nip rollers that mutually contact each other via the endless belt 33. The nip roller pair 30 retains the flexible printed wiring board material 28 in a state where the flexible printed wiring board material 28 has been inserted, via the endless belt 33, between the nip rollers of the nip roller pair 30, and feeds the endless belt 33 and the flexible printed wiring board material 28 as a result of the nip roller pair 30 rolling.

Figure 6:
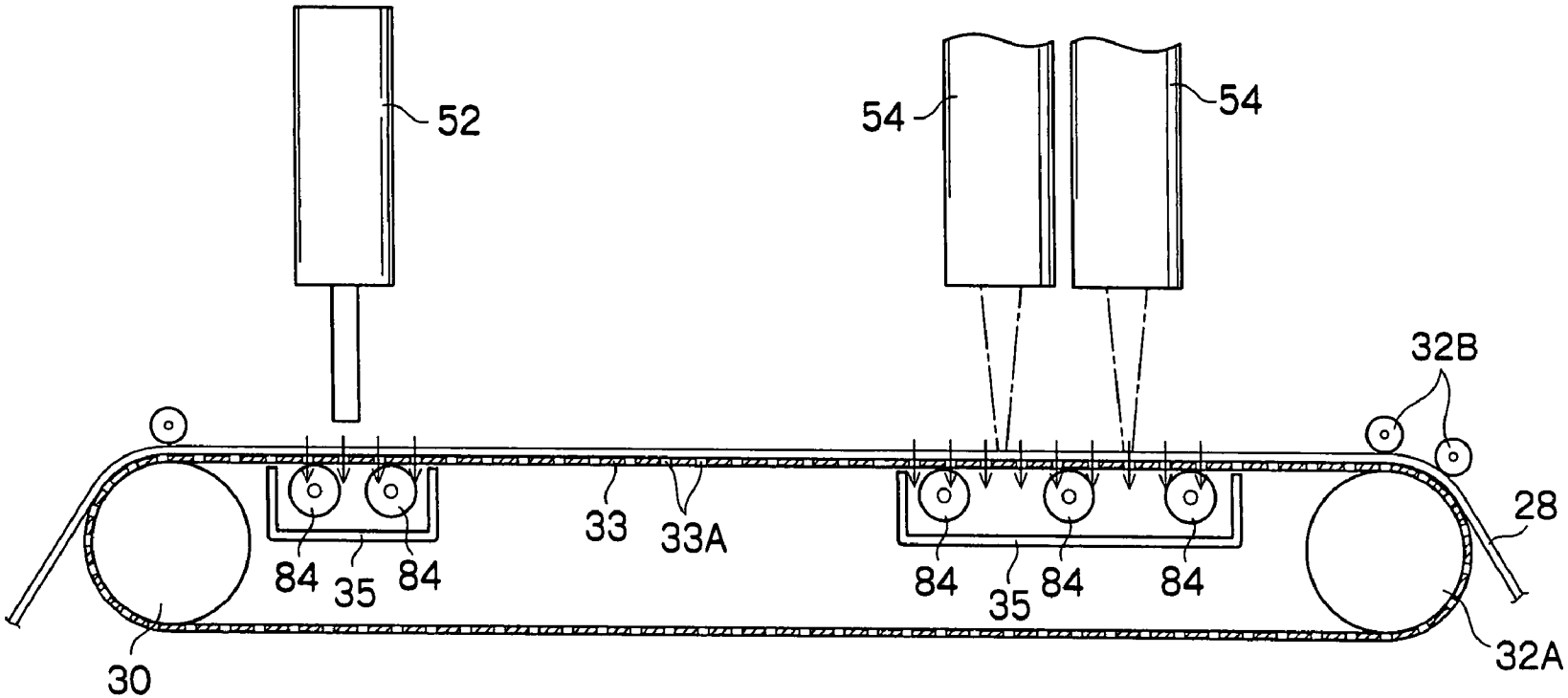
FIG. 6 is an enlarged schematic configural diagram showing an example where a guide for an endless belt is disposed on a portion of a conveyance path in an exposure processing section in the image forming apparatus pertaining to the embodiment of the invention.
Figure 7:
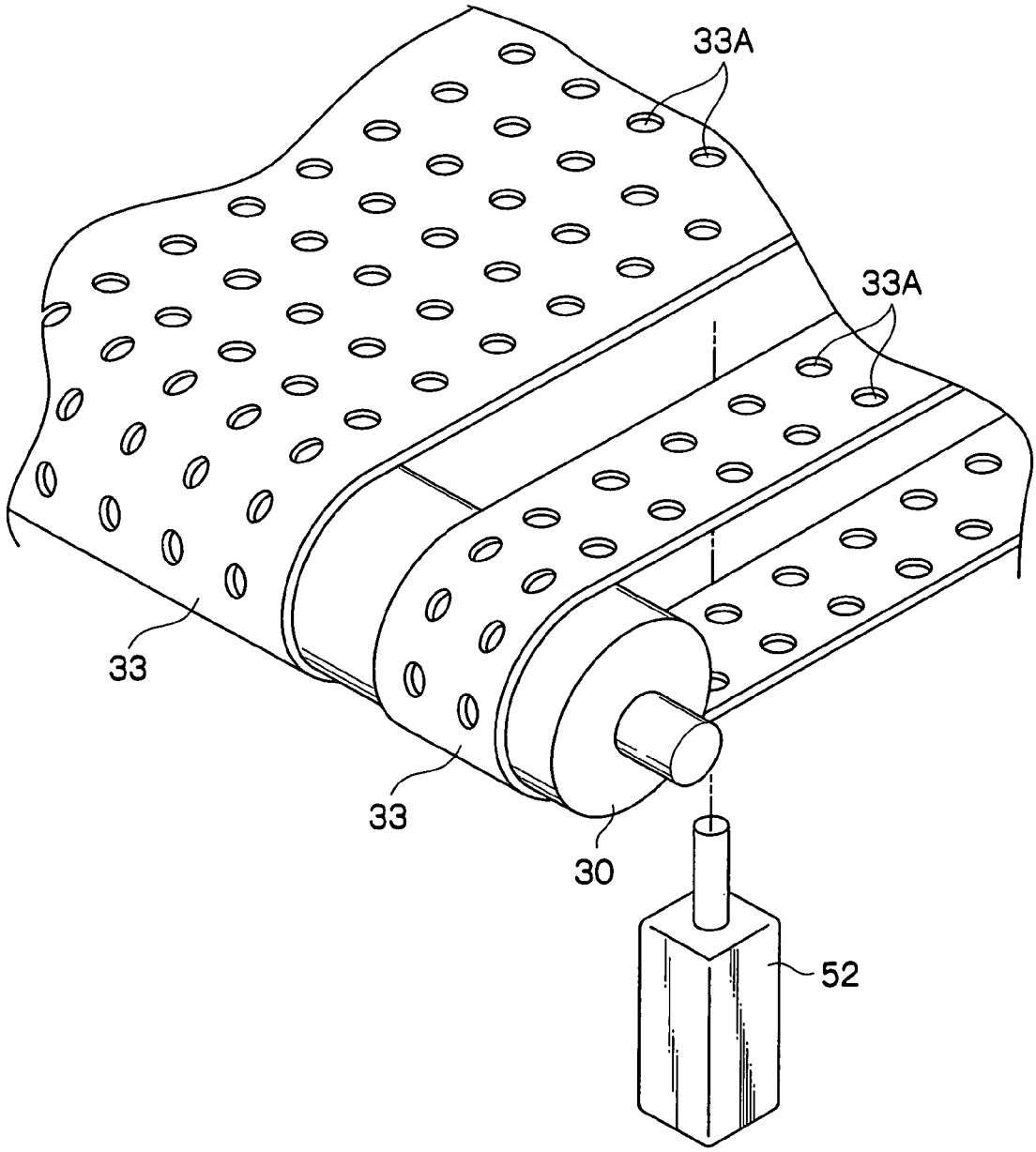
FIG. 7 is a schematic configural diagram showing an example where a camera of an alignment unit is disposed opposite from a head assembly in the conveyance path in the exposure processing section in the image forming apparatus pertaining to the invention.
Figure 8:
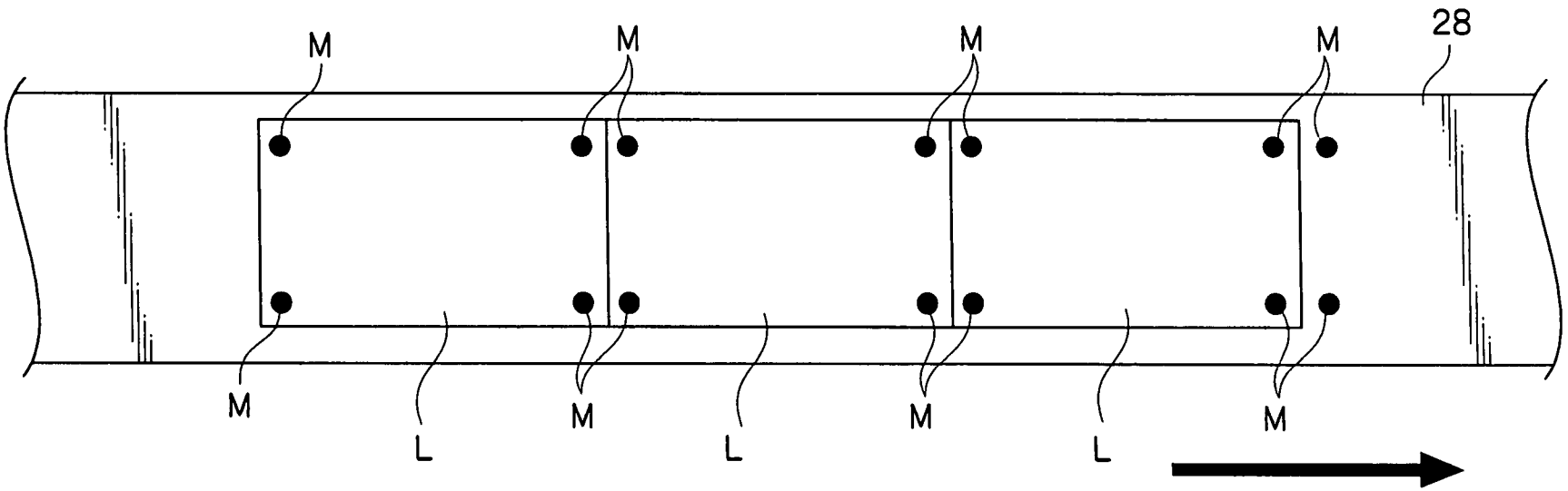
FIG. 8 is a plan view showing a flexible printed wiring board material exposed by the image forming apparatus pertaining to the embodiment of the invention.

As shown in FIGS. 6 and 7, suction-use holes 33A that are numerous circular through holes are averagely distributed and formed in the endless belt 33.

The detection unit-attached scan-use conveyance unit 26 includes a suction box 35 that configures suction means (a mechanism) and is adjacent to the underside of the upper stretched portion of the endless belt 33 disposed along the conveyance path in order for the flexible printed wiring board material 28 to be placed thereon.

The suction box 35 is disposed across a predetermined range including at least an alignment area and an exposure area at positions directly under a later-described alignment unit 46 and exposure head unit 48.

The suction box 35 configuring the suction means is formed in a lidless rectangular box-like shape and is disposed adjacent to the underside of the upper stretched portion of the endless belt 33. Thus, the suction box 35 is configured to create a suction-use semiclosed space surrounded by the endless belt 33 and the suction box 35.

In this suction means, an end portion of an unillustrated intake pipe pulled out from a blower 37 is connected to the suction box 35. The blower 37 configuring the suction means is configured to suck the flexible printed wiring board material 28 to the surface of the endless belt 33 by the action of sucking in the air in the semi-closed space surrounded by the endless belt 33 and the suction box 35 and sucking in the air from the suction-use holes 33A in the endless belt 33.

In the detection unit-attached scan-use conveyance unit 26 configured in this manner, the blower 37 is driven to suck in the air in the semi-closed space surrounded by the endless belt 33 and the suction box 35, whereby the portion of the flexible printed wiring board material 28 inserted from the nip roller pair 30 to the conveyance path of the exposure processing section 12 is sucked by the negative pressure from the suction-use holes 33A in the endless belt 33. In this state, the flexible printed wiring board material 28 is conveyed integrally with the endless belt 33 and conveyed from the nip drive roller pair 32.

While the flexible printed wiring board material 28 is conveyed in this manner from the nip roller pair 30 to the nip drive roller pair 32, it is continuously conveyed in a constant conveyance direction as the state in which the flexible printed wiring board material 28 is sucked to the endless belt 33 is maintained. Namely, the detection unit-attached scan-use conveyance unit 26 is configured so that the flexible printed wiring board material 28 is placed on the endless belt 33 and the endless belt 33 is continuously driven so that exposure can be conducted. For this reason, exposure can always be continuously conducted and productivity can be raised.

Also, the detection unit-attached scan-use conveyance unit 26 is configured so that the flexible printed wiring board material 28 is closely adhered to the highly flat endless belt 33 and the focal distance from the exposure head unit 48 can be maintained at a constant.

Particularly when the endless belt 33 is configured by a metal belt rather than a cloth belt, great tension is imparted to the endless belt 33 and higher flatness can be obtained, and the flatness of the flexible printed wiring board material 28 sucked on the endless belt 33 can be raised. Therefore, the focal distance from the exposure head unit 48 can be maintained at a constant with higher precision.

According to the configuration where the flexible printed wiring board material 28 is flatly disposed on the endless belt 33 and exposure is continuously conducted on the conveyance path whose continuous flat surface is set in this manner, when a two-dimensional pattern is irradiated by a two-dimensional spatial modulator (DMD) (i.e., when so-called surface exposure is conducted), it can be ensured that the focal distance does not change in the board feeding direction in the exposure region because the flatness of the flexible printed wiring board material 28 is high even if the exposure region is wide in the conveyance direction of the flexible printed wiring board material 28, and an excellent image can be obtained.

On the conveyance path of the detection unit-attached scan-use conveyance unit 26, because excellent flatness of the flexible printed wiring board material 28 can be secured as described above, the image forming apparatus can be configured so that tension is not applied in the conveyance direction to the flexible printed wiring board material 28 itself, and the flexible printed wiring board material 28 can be prevented from being deformed by being expanded/contracted by tension. Thus, the detection unit-attached scan-use conveyance unit 26 can prevent the exposed image from being displaced (so-called exposure position displacement) when the flexible printed wiring board material 28 is exposed in a state where it is elastically expanded/contracted and deformed by tension and the exposed image is displaced when the tension that had been applied is released and the flexible printed wiring board material 28 returns to its former shape.

In this image forming apparatus, the exhaust air of the blower 37 is passed through a precise air conditioner 39, where dust is removed, and it is reflowed within a clean room in which the image forming apparatus is disposed. Thus, the other end of an exhaust pipe 41, whose one end is connected to the exhaust port of the blower 37, is connected to an air intake port of the precise air conditioner 39.

Thus, the air taken in by the blower 37 in order to cause the flexible printed wiring board material 28 to be sucked onto the endless belt 33 from the suction box 35 passes through the exhaust pipe 41 and is regenerated in the precise air conditioner 39. The precise air conditioner 39 uses a high efficiency particulate air (HEPA) filter to purify the air sent from the blower 37 and the air taken in from the inside of the housing of the image forming apparatus, and reflows the purified air within the clean room.

When a large amount of air sent from the blower 37 is discharged to the outside of the clean room, it is necessary to raise the air conditioning power for supplying fresh clean air to the inside of the clean room, and costs become high. However, according to the above configuration, this can be prevented. Also, when the exhaust air of the blower 37 is discharged as is to the inside of the clean room, the dust from the blower 37 pollutes the clean room, but this can be prevented.

In the conveyance path of the detection unit-attached scan-use conveyance unit 26A, a guide roller 38 is disposed upstream of the nip roller pair 30, and a guide roller 40 is disposed downstream of the nip drive roller pair 32.

As shown in FIG. 2, correction scales 42 are disposed at an outer side of the nip roller pair 30 of the detection unit-attached scan-use conveyance unit 26, at a predetermined position on an extension line upstream in the conveyance direction with respect to the exposure-use conveyance path of the flexible printed wiring board material 28 set therein.

Moreover, beam position detection devices 44 and exposure surface power measurement devices 45 are disposed at an outer side of the nip drive roller pair 32 of the detection unit-attached scan-use conveyance unit 26, at a predetermined position on an extension line downstream in the conveyance direction with respect to the exposure-use conveyance path of the flexible printed wiring board material 28 set therein.

As shown in FIGS. 1 and 2, an alignment unit 46 is disposed upstream in the conveyance direction above the board conveyance unit 22 in the exposure processing section 12, and the exposure head unit 48 serving as an image forming unit is disposed downstream in the conveyance direction.

Although not illustrated, the alignment unit 46 is disposed with a base 50 attached to a fixing structure such as the housing of the image forming apparatus. A pair of parallel rails (not shown) is disposed in the base 50, and plural (four in the present embodiment) cameras 52 are disposed so as to be movable to align the optical axes of lenses with desired positions in the width direction of the flexible printed wiring board material 28 via a camera base moved by a ball screw mechanism.

Although not illustrated, each camera 52 includes a lens attached to the undersurface of the camera body and a ring-like strobe light source (LED strobe light source) attached to a protruding end portion of the lens. The camera 52 irradiates the flexible printed wiring board material 28 with light from the strobe light source, the reflected light is imaged by the camera body via the lens, and the end portion of the flexible printed wiring board material 28 or marks M (see FIG. 8) is/are detected.

As shown in FIGS. 1 and 2, the exposure head unit 48 serving as an image forming unit disposed in the exposure processing section 12 is attached to vertically disposed support poles (not shown) at the outer sides of both width-direction end portions of the conveyed flexible printed wiring board material 28.

Because the exposure head unit 48 serving as an image forming unit is configured as a laser exposure device, plural head assemblies 54 are arranged in a substantial matrix of m lines and n rows (in the present embodiment, 2 lines and 4 rows, for a total of 8). The lines of the plural head assemblies 54 are disposed along the width direction of the flexible printed wiring board material 28 (direction orthogonal to the scanning direction, which is the conveyance direction, of the flexible printed wiring board material 28).

As shown in FIG. 1, a light source unit 56 is disposed in the image forming apparatus housing. Although not illustrated, the light source unit 56 houses plural laser (semiconductor laser) light sources, and the light beams emitted from the laser light sources are introduced to the corresponding head assemblies 54 by optical fibers.

The head assemblies 54 modulate the introduced light beams with an unillustrated digital micromirror device (DMD) that is a spatial light modulator, focus the light beams on the flexible printed wiring board material 28 with an auto focus mechanism, and irradiate a two-dimensional pattern (so-called surface exposure).

The DMD of each head assembly 54 is controlled in dot units on the basis of image data by the image processor of the control unit 58 to expose a dot pattern on the flexible printed wiring board material 28.

The exposure head unit 48 serving as an image forming unit conducts exposure by irradiating the flexible printed wiring board material 28 with the plural light beams emitted from the head assemblies 54 at a predetermined timing while the flexible printed wiring board material 28 is being conveyed at a constant speed. At this time, the head assemblies 54 conduct exposure after focusing the light beams with the auto focus mechanism at the exposure time, so that appropriate exposure can be conducted even if there is a slight fluctuation in the height position of the flexible printed wiring board material 28.

In the exposure head unit 48, the exposure area resulting from one head assembly 54 is inclined at a predetermined inclination angle with respect to the scanning direction so that the exposure area becomes rectangular, with the short edges being in the scanning direction, to form a band-like exposed region per head assembly 54 on the flexible printed wiring board material 28 conveyed in the scanning direction.

Because the exposure head unit 48 conducts exposure with the exposure area being inclined at a predetermined inclination angle with respect to the scanning direction, the dot pattern in the two-dimensional arrangement to be exposed is inclined with respect to the scanning direction. Thus, the dots arranged in the scanning direction pass between the dots arranged in the direction intersecting the scanning direction, so that the substantial inter-dot pitch is narrowed, whereby high definition can be obtained.

In this image forming apparatus, when displacement occurs in the relative positional relationship between the conveyed flexible printed wiring board material 28 and the exposure head unit 48, the cameras 52 image the marks M disposed on the flexible printed wiring board material 28 to detect the amount of displacement in the positions of the flexible printed wiring board material 28 and the exposure head unit 48, so that the exposure by the exposure head unit 48 is corrected and appropriate exposure can be executed with respect to the flexible printed wiring board material 48.

As shown in FIGS. 1 and 2, because the image forming apparatus continuously conducts exposure processing while conveying the flexible printed wiring board material 28 on the conveyance path disposed in the exposure processing section 12, the unexposed recording medium supply section 14 is connected to the upstream side of the conveyance path of the exposure processing section 12, and the exposed recording medium collection section 16 is connected to the downstream side of the conveyance path of the exposure processing section 12.

The unexposed recording medium supply section 14 is configured by a supply reel 60, around which the long unexposed flexible printed wiring board material 28 is wound, and a spacer tape take-up reel 62 that are attached to a drive unit 64.

The recording medium supply section 14 is configured to carry the flexible printed wiring board material 28 pulled out from the supply reel 60 to the entrance of the recording medium conveyance path of the exposure processing section 12 via a dancer roller mechanism that is tension setting means (a mechanism) for ensuring that the flexible printed wiring board material 28 is flatly and closely adhered to the endless belt 33.

Although not illustrated, a first dancer roller mechanism for adjusting differences in the conveyance speed may be disposed between the supply reel 60 and the entrance of the recording medium conveyance path of the exposure processing section 12, and a second dancer roller mechanism that is tension setting means may be disposed via a clean roller.

The dancer roller mechanism is configured to place the flexible printed wiring board material 28 between an exit-side roller 66 of the unexposed recording medium supply section 14 and the guide roller 38 at the entrance of the exposure processing section 38 and roll the dancer roller 68 at the portion curved in a U-shape. The dancer roller mechanism can be replaced with a so-called air dancer having a configuration that pulls the flexible printed wiring board material 28 with air. The second dancer roller mechanism that is tension setting means is configured to apply a relatively weak tension that is necessary in order to cause the flexible printed wiring board material 28 to be flatly and closely adhered to the endless belt 33.

The recording medium supply section 14 pulls out the flexible printed wiring board material 28 as a result of the drive unit 64 rotating/driving the supply reel 60, carries the flexible printed wiring board material 28 between the nip roller pair 30 of the exposure processing section 12 and the endless belt 33 via the dancer roller mechanism, and continuously supplies the flexible printed wiring board material 28 so that the flexible printed wiring board material 28 does not slip on the endless belt 33 on the conveyance path.

In the supply reel 60, a spacer tape 61 is disposed between the flexible printed wiring board materials 28 so that the wound flexible printed wiring board materials 28 do not directly contact each other. For this reason, in the recording medium supply section 14, the drive unit 64 rotates/drives the spacer tape take-up reel 62 to take up, at the spacer tape take-up reel 62, the spacer tape 61 approaching together with the conveyed flexible printed wiring board material 28.

The exposed recording medium collection section 16 is configured by a take-up reel 70, around which the long exposed flexible printed wiring board material 28 is wound, and a spacer tape supply reel 72 that are attached to a drive unit 74.

In the recording medium collection section 16, the exposed flexible printed wiring board material 28 conveyed from the exposure processing section 12 is wound around the take-up reel 70 via a dancer roller mechanism serving as tension setting means (a mechanism) connected to the exit of the recording medium conveyance path of the exposure processing section 12.

The dancer roller mechanism is configured to place the flexible printed wiring board material 28 between a retention roller 76 disposed at the downstream side in the conveyance direction from the exit guide roller 40 of the exposure processing section 12 and an entrance-side roller 78 of the recording medium collection section 16 and roll the dancer roller 68 at the portion curved in a U-shape.

In the recording medium collection section 16, a nip roller pair 80 is disposed between the entrance-side roller 78 and the take-up reel 70. Because the exposed flexible printed wiring board material 28 is wound around the take-up reel 70, the exposed flexible printed wiring board material 28 is pulled, but the tension working at this time is absorbed by the nip roller pair 80 so that the tension is not transmitted to the dancer roller mechanism disposed at the upstream side in the conveyance direction of the exposed recording medium collection section 16.

In the recording medium collection section 16 configured in this manner, the drive unit 74 rotates/drives the take-up reel 70 to continuously wind and collect the flexible printed wiring board material 28 sent from the exposure processing section 12 via the dancer roll mechanism.

In the recording medium collection section 16, the spacer tape 61 is wound between the winding surfaces so that the flexible printed wiring board materials 28 being wound around the take-up reel 70 do not directly contact each other when the flexible printed wiring board material 28 is wound around the take-up reel 70. Thus, in the recording medium collection section 16, the drive unit 74 rotates the spacer tape take-up reel 72 to pull out the spacer tape 61 from the spacer tape supply reel 72 so that the spacer tape 61 can be disposed on the approaching flexible printed wiring board material 28.

As shown in FIGS. 1 and 2, in the image forming apparatus of this configuration, a belt conveyance mechanism is disposed between the nip roller pair 30 and the nip drive roll pair 32 of the exposure-use conveyance path of the exposure processing section 12.

In the exposure-use conveyance path of the exposure processing section 12, the blower 37 is driven, whereby the air in the semi-closed space surrounded by the endless belt 33 and the suction box 35 is sucked in, and the flexible printed wiring board material 28 is sucked to the surface of the endless belt 33 by the action of sucking in the air from the suction-use holes 33A in the endless belt 33 so that the flexible printed wiring board material 28 becomes integrated with the surface of the endless belt 33. The flexible printed wiring board material 28 is exposed by the exposure head unit 48 while being conveyed in the main traveling direction (main scanning direction) at a predetermined speed by the rotation/drive force of the nip drive roller pair 32 in a sucked state.

When the exposure processing section 12 conducts exposure, the flexible printed wiring board material 28 is flatly supported by the endless belt 33 between a position below the alignment unit 46 and a position below the exposure head unit 48 on the exposure-use conveyance path. A predetermined tension works due to the dancer roll mechanism disposed at the upstream side in the conveyance direction and the dancer roll mechanism disposed at the downstream side in the conveyance direction, so that the flexible printed wiring board material 28 stretched on the exposure-use conveyance path of the exposure processing section 12 is stably retained without becoming slack on the endless belt 33.

Thus, the exposure processing section 12 can appropriately conduct exposure, with the head assemblies of the exposure head unit 48, with a two-dimensional pattern with respect to the surface of the flexible printed wiring board material 28 flatly retained by the endless belt 33.

Moreover, the exposure processing section 12 can continuously conduct exposure with the exposure head unit 48 with respect to the flexible printed wiring board material 28 being conveyed at a constant speed in the main traveling direction. For this reason, the exposure processing section 12 rapidly and rationally conducts exposure processing without having to reciprocate the flexible printed wiring board material 28 directly below the exposure head unit 48, so that the operating efficiency can be improved.

Also, in the image forming apparatus, the control unit 58 determines, on the basis of position data of the marks M or end portion obtained as a result of the alignment unit 46 imaging the flexible printed wiring board material 28, a correction factor pertaining to the exposure start position when the flexible printed wiring board material 28 is exposed by the exposure head unit 48 and the shift position of dots in the width direction of the flexible printed wiring board material 28. Then, on the basis of the correction factor, the control unit 58 executes control that corrects the two-dimensional image forming pattern by the head assemblies 54 of the exposure head unit 48 and the image recording start period so that the position of the image to be exposed on the flexible printed wiring board material 28 is at an appropriate position.

In the exposure processing section 12 of the image forming apparatus, the portion serving as the detection target of the flexible printed wiring board material 28 directly below the alignment unit 46 and the portion serving as the detection target of the flexible printed wiring board material 28 directly below the exposure head unit 48 both receive the same tension and are conveyed at the same speed in the main traveling direction (main scanning direction). For this reason, the detection result of the alignment unit 46 can be applied to the exposure head unit 48 without error, and the precision of exposure can be further improved.

Next, the correction means (a mechanism) of the alignment unit 46 used in the image forming apparatus will be described. In the image forming apparatus, the alignment unit 46 executes alignment for appropriately adjusting the relative positional relationship between the flexible printed wiring board material 28 and the exposure head unit 48.

In the alignment of the image forming apparatus, when size data of the flexible printed wiring board material 28 are inputted by an unillustrated input unit, the positions of the cameras 52 of the alignment unit 46 are moved/adjusted, on the basis of the inputted size data, to be aligned with the width-direction position of the flexible printed wiring board material 28.

In the image forming apparatus, a predetermined range in the longitudinal direction of the flexible printed wiring board material 28 moving in the main scanning direction is imaged by the cameras 52, the marks M formed in advance on the flexible printed wiring board material 28 for detecting the exposure positions are detected and compared with the reference positions of the cameras 52, exposure-use correction data are generated, the timing until the exposure start position of the flexible printed wiring board material 28 reaches the exposure beam irradiation position of the exposure head unit 48 is measured using an unillustrated pulse counter or the like on the basis of the correction data, and the exposure operation is conducted.

In the image forming apparatus, position correction of the alignment-use cameras 52 is conducted in order to improve the appropriateness of alignment. The position correction of the alignment-use cameras 52 is conducted using the correction scales 42.

For this reason, in the image forming apparatus, the linear movement mechanism 20 is driven, the entire board conveyance unit 22 (the scan-use conveyance unit 26 disposed with the moving table 21, the board thickness adjustment-use Z stage 24, the nip roller pair 30, the nip drive roller pair 32 and the correction scales 42) is moved in the right direction (of FIG. 2) from the exposure standby position shown in FIG. 2 and set at an alignment correction-use position shown in FIG. 3.

At the alignment correction-use position shown in FIG. 3, the cameras 52 and the corresponding correction scales 42 face each other. In this state, the alignment-use cameras 52 are moved in the board width direction on the basis of width position information of the designated alignment marks M.

In the image forming apparatus, the correction scales 42 are disposed closer to the cameras 52 than the conveyance path of the flexible printed wiring board material 28. For this reason, position correction of the alignment-use cameras 52 can be conducted in a state where the flexible printed wiring board material 28 has entered the conveyance path of the detection unit-attached scan-use conveyance unit 26.

In the image forming apparatus, the correction scales 42 are imaged by the alignment-use cameras 52, and the positional relationship between the cameras 52 and the correction scales 42 is corrected from the positions at which the patterns of the correction scales 42 have been imaged.

In the image forming apparatus, after the completion of the alignment camera correction operation, an operation is conducted which drives the linear movement mechanism 20 and causes the board conveyance unit 22 to return to the exposure standby position shown in FIG. 2 from the alignment camera correction-use position shown in FIG. 3.

Next, correction means (a mechanism) relating to the exposure position of the head assemblies 54 and the power distribution in the exposure regions used in the image forming apparatus will be described.

In the image forming apparatus, first, the detection unit-attached scan-use conveyance unit 26 is moved from the exposure standby position shown in FIG. 2 in the left direction (of FIG. 2) to the beam position detection position shown in FIG. 4 so that the head assemblies 54 and the corresponding beam position detection devices 44 face each other in order to measure the beam positions of the head assemblies 54. Then, the beam positions of the head assemblies 54 are measured with the beam position detection devices 44 to correct the exposure position of the head assemblies 54.

Next, in the image forming apparatus, the detection unit-attached scan-use conveyance unit 26 is moved from the beam position detection position shown in FIG. 4 in the left direction (of FIG. 4) to the exposure surface power correction position where the head assemblies 54 and the exposure surface power measurement devices 45 face each other in order to measure the power distribution within the exposure region of the head assemblies 54 (see FIG. 5).

Then, the power distribution within the exposure regions of the head assemblies 54 is measured by the corresponding exposure surface power measurement devices 45 to correct the power in the entire exposure region, whereby an appropriate two-dimensional pattern can be formed.

In the image forming apparatus, the beam position detection devices 44 and the exposure surface power measurement devices 45 are disposed closer to the exposure head unit 48 than the conveyance path of the flexible printed wiring board material 28. For this reason, correction of the exposure position of the head assemblies 54 and power correction in the entire exposure region of the head assemblies can be conducted in a state where the flexible printed wiring board material 28 has entered the conveyance path of the detection unit-attached scan-use conveyance unit 26.

In the image forming apparatus, after the completion of the operation of correcting the exposure position of the head assemblies 54 and the operation of correcting the power in the entire exposure region, an operation is conducted which drives the linear movement mechanism 20 and causes the entire board conveyance unit 22 to return to the exposure standby position shown in FIG. 2 from the exposure surface correction position shown in FIG. 5.

Next, the action and operation of the image forming apparatus configured as described above will be described.

In the image forming apparatus, prior to the start of exposure, the correction with respect to the alignment cameras 52, and correction of the exposure position with respect to the head assemblies 54 and the power distribution within the exposure region, are conducted. The correction with respect to the alignment cameras 52, and correction of the exposure position with respect to the head assemblies 54 and the power distribution within the exposure region, can be conducted as needed.

Next, in the image forming apparatus, the flexible printed wiring board material 28 serving as the exposure target is set on the conveyance path leading from the recording medium supply section 14 through the exposure processing section 12 to the recording medium collection section 16. For this reason, the flexible printed wiring board material 28 that is a recording medium is removed from the supply reel 60, passed through the conveyance path of the exposure processing section 12, and the leading end is fixed to the take-up reel 70.

Thereafter, the supply reel 60 is rotated until the fact that the slackest part of the flexible printed wiring board material 28 has reached a predetermined amount (maximum slack) is detected at the portion between the exit-side roller 66 disposed at the supply reel 60 side and the entrance guide roller 38 disposed at the exposure processing section 12 side, and the dancer roller 68 is set at the slack portion. From then on, when the fact that the slack has reached a least slack amount (least slack) is detected, the rotation/driving of the supply reel 60 is adjusted until the fact that the slack has become the maximum slack amount is detected.

Next, in the image forming apparatus, the nip drive roller pair 30 is rotated/driven until the fact that the least slack of the flexible printed wiring board material 28 has reached a predetermined amount (minimum slack) is detected at the portion between the retention roller 76 at the conveyance path exit side of the exposure processing section 12 and the entrance-side roller 78 of the exposed recording medium collection section 16, and the dancer roller 68 is set at the slack portion. From then on, when the fact that the slack has reached the maximum slack amount (maximum slack) is detected, the rotation/driving of the take-up reel 70 is adjusted until the fact that the slack has become the minimum slack amount is detected.

Next, the nip drive roller pair 32 is rotated/driven, the flexible printed wiring board material 28 is fed, and the surface of the flexible printed wiring board material 28 is imaged by the alignment cameras 52 at predetermined intervals. When the mark Ms at the exposure start position disposed on the flexible printed wiring board material 28 are imaged (detected), the nip drive roller pair 32 is stopped and made to stand by.

Next, the nip drive roller pair 32 is rotated, and when a predetermined amount of the flexible printed wiring board material 28 has been fed, the alignment marks M in a unit exposure region L disposed on the flexible printed wiring board material 28 are imaged, and the positions of the marks M in the unit exposure region L are measured. It is preferable for the measurement of the positions of the marks M in the unit exposure region L to be conducted at at least two places in the unit exposure region L in the feeding direction of the flexible printed wiring board material 28 shown in FIG. 8 (at at least four places in the periphery of the unit exposure region L), but the measurement may be conducted at two places (top and bottom or left and right of the unit exposure region L) when the board is not expanded/contracted and deformed.

Next, when the measurement of the positions of the marks M in the unit exposure region L ends, the control unit 58 conducts deformation of the exposure data so that the exposure image corresponds to the expansion/contraction deformation state from the measured value of the positions of the marks M in the unit exposure region L. The control unit 58 may also be configured to conduct processing including image recording position correction (exposure start period correction).

While the control unit 58 is conducting deformation of the exposure data, the control unit 58 conducts control to continuously feed the flexible printed wiring board material 28, and conducts measurement of the positions of the alignment marks M in the next unit exposure region L.

Next, the control unit 58 ends the deformation of the exposure data. When the leading part of the unit exposure region L is fed to the position of the exposure head unit 48, exposure of the flexible printed wiring board material 28 is begun by the head assemblies 54, and exposure with respect to the unit exposure region L is stopped when the trailing end of the unit exposure region L reaches a predetermined position past the exposure head unit 48.

The exposure is conducted when the unit exposure region L of the flexible printed wiring board material 28 passes through the exposure region resulting from the exposure head unit 48. In this exposure, the head assemblies 54 irradiate the DMDs with laser light on the basis of the exposure data deformed by the control unit 58, the laser light reflected when the micromirrors of the DMDs are ON passes through an optical path set by an optical system and is imaged on the flexible printed wiring board material 28.

In the image forming apparatus, the exposure is continuously conducted, and when the unit exposure region L has been exposed a pre-designated number of times, the nip drive roller pair 32 is stopped and the exposure ends.

As described above, in the image forming apparatus, the flexible printed wiring board material 28 is disposed on the endless belt 33 of the belt conveyance mechanism wound between the nip roller pair 30 and the nip drive roller pair 32, and the nip drive roller pair 32 is rotated at a constant speed, whereby the flexible printed wiring board material 28 is continuously fed integrally with the endless belt 33. Then, the stretched portion of the flexible printed wiring board material 28 wound, via the endless belt 33, between the nip roller pair 30 and the nip drive roller pair 32 is continuously laser-exposed and image is formed by the head assemblies 54. Thus, the image forming apparatus can always continuously conduct exposure in comparison to an apparatus that conducts processing for adjusting the alignment of the recording medium on one path and conducts exposure on the return path. Thus, the image forming apparatus can raise productivity.

Next, an example where a guide for the endless belt 33 is disposed on the conveyance path of the exposure processing section 12 in the image forming apparatus will be described with reference to FIG. 6.

In the exposure processing section 12 shown in FIG. 6, contact rollers 84 serving as lower support means (a mechanism) are disposed at positions directly below the endless belt 33 corresponding to the entire exposure region resulting from the head assemblies 54 on the conveyance path.

The contact rollers 84 contact and guide the undersurface of the endless belt 33 so as to support the endless belt 33 from below. As shown in FIG. 6, the contact rollers 84 are disposed at the upstream side and the downstream side in the conveyance direction so as to sandwich the exposure regions resulting from the head assemblies 54. The contact rollers 84 are also disposed at the upstream side and the downstream side in the conveyance direction so as to sandwich the imaging region resulting from the cameras 52. By disposing the contact rollers 84 in this manner, the endless belt 33 can be prevented from being pulled towards the suction box 35 when the air is sucked from the suction box 35.

Here, in place of the contact rollers 84, the exposure processing section 12 shown in FIG. 6 may also be configured so that the surface of a suction stage (not shown) disposed with numerous suction-use holes slides against and guides the undersurface of the endless belt 33. When the exposure processing section 12 is configured in this manner, the flexible printed wiring board material 28 is sucked against the surface of the endless belt 33 by the sucking action from the suction-use holes 33A in the endless belt 33 communicated with the numerous suction-use holes disposed in the suction stage.

In the configuration shown in FIG. 6, suction boxes 35 are separately disposed at portions corresponding to the exposure regions and imaging regions.

By disposing the contact rollers 84 in this manner, flexible printed wiring board material 28 supported and conveyed by the endless belt 33 on the conveyance path is exposed by the head assemblies 54 while being indirectly supported and guided, so as to maintain its flat state, by the contact rollers 84 from the underside of the endless belt 33. When the exposure processing section is configured in this manner, flatness can be maintained at a higher precision when conducting exposure, and the flat surface of the flexible printed wiring board material 28 can be prevented from fluctuating due to an external disturbance. Thus, exposure processing can be conducted at a more stable quality.

Also, when two of the contact rollers 84 are disposed at the undersurface of the endless belt 33 in the vicinity of the exposure position and the space between the contact rollers 84 is sucked by the suction box 35, the depression in the endless belt 35 resulting from the suction can be reduced, the flexible printed wiring board material 28 can be flatly retained, and an excellent exposure surface can be obtained. The same can be done in regard to the endless belt 33 in the vicinity of the alignment position, so that alignment can be done appropriately.

The contact rollers 84 serving as lower support means may also be configured so that, other than being disposed at a position directly below the cameras 52 and a position directly below the exposure head unit 48, one or several guide rollers contact an optional position at the underside of the endless belt 33 and guide and flatly convey the flexible printed wiring board material 28 so as to maintain its flat state.

Next, with reference to FIG. 7, an example will be described where, in the image forming apparatus shown in FIGS. 1 to 5, the alignment unit 46 is disposed below the conveyance path of the exposure processing section 12 (at the side opposite from the side disposed with the head assemblies 54 of the exposure head unit 48) to enlarge the layout freedom.

In the exposure processing section 12 shown in FIG. 7, the alignment unit is disposed below the conveyance path of the exposure processing section 12. Moreover, the alignment mark M is formed on the undersurface (with respect to the surface that is exposed) of the flexible printed wiring board material 28.

In the exposure processing section 12 shown in FIG. 7, the endless belt 33 stretched between the nip roller pair 30 and the nip drive roller pair 32 is divided into plural belts, and the plural belts are disposed at predetermined intervals. As shown in FIG. 7, the cameras 52 are configured to image the alignment mark M formed on the undersurface of the flexible printed wiring board material 28 through the gaps between the belts.

In the image forming apparatus configured in this manner, the alignment mark M formed on the undersurface of the flexible printed wiring board material 28 is detected by the alignment unit disposed below the conveyance path and exposure is conducted while conducting alignment.

Also, in the image forming apparatus pertaining to the present embodiment, even if the configuration for sucking the flexible printed wiring board material 28 to the endless belt 33 (the suction box 35, the suction-use holes 33A disposed in the endless belt 33, and the blower 37) is eliminated and exposure is conducted while driving the endless belts 33 in a state where the flexible printed wiring board material 28 is disposed on the surface of the endless belt 33, the focal distance from the bear assemblies 54 can be maintained at a constant because the flexible printed wiring board material 28 is flatly disposed on the highly flat endless belt 33.

Moreover, in the image forming apparatus pertaining to the present embodiment, if the dancer roller mechanism that is tension setting means is eliminated and the flexible printed wiring board material 28 is sucked and conveyed on the surface of the endless belt 33, excellent flatness can be secured even if tension is not applied to the flexible printed wiring board material 28. When the image forming apparatus is configured in this manner, there is no tension from the tension setting means on the flexible printed wiring board material 28. Thus, exposure position displacement resulting from the expansion and contraction of the flexible printed wiring board material 28 can be reduced, and correction for this can be simplified.

In the present embodiment, a DMD was used as a spatial light modulator used in the head assemblies 54 of the exposure head unit 48 configured as a laser exposure device, the lighting time was made constant and the micromirrors were turned ON/OFF to generate the dot pattern. However, pulse width modulation resulting from ON time ratio (duty) control may also be conducted. Also, the dot pattern may be generated by the lighting number of times using the one lighting time as an extremely short time.

Moreover, in the present embodiment, as example was described where the head assemblies 54 were disposed with the DMD as a spatial light modulator, but in addition to a reflective type spatial light modulator, a spatial light modulator other than an MEMS (Micro Electro Mechanical System) type can be used instead of the DMD, such as an MEMS type spatial light modulator (SLM), a transmissive type spatial light modulator (LCD), an optical element that modulates transmitted light using an electro-optical effect (PLZT element), and a liquid crystal shutter array of a liquid crystal shutter (FLC). Moreover, a device where grating light valves (GLV) are plurally arranged and configured in a two-dimensional shape can also be used. In a configuration using such a reflective type spatial light modulator (GLV) or a transmissive type spatial light modulator (LCD), a lamp can be used as the light source in addition to the aforementioned laser.

Also, as the light source in the present embodiment, a fiber array light source disposed with plural multiplex laser light sources, a fiber array light source in which fiber light sources disposed with one optical fiber that emits laser light made incident from a single semiconductor laser including one light-emitting point are arranged in an array, and a light source where plural light-emitting points are two-dimensionally arranged (e.g., an LD array, an organic EL array) can be applied.

The image forming apparatus may also be configured to use a laser exposure device using a polygon mirror that conducts exposure in lines in addition to the head assemblies that conduct exposure by irradiating a two-dimensional pattern.

The image forming apparatus can also use either a photon mode photosensitive material in which information is directly recorded by exposure or a heat mode photosensitive material in which information is recorded by heat generated by exposure. When the photon mode photosensitive material is used, a GaN semiconductor laser or a wavelength converting solid laser is used for the laser device. When the heat mode photosensitive material is used, an AlGaAs semiconductor laser (infrared laser) or a solid laser is used for the laser device.

Moreover, in the present embodiment, an example was described where the flexible printed wiring board material 28 stretched between the nip roll pair 30 and the nip drive roll pair 32 was stretched with a constant tension by the dancer roller mechanism serving as tension setting means disposed at the conveyance direction upstream side of the nip roller pair 30 and the dancer roller mechanism serving as tension setting means disposed at the conveyance direction downstream side of the nip drive roller pair 32, but the tension setting means used here may be configured to add a constant tension varying the speeds between one nip roller pair and the other nip roller pair and rotating/driving the nip roller pairs or to add a constant tension by controlling one nip roller pair with a predetermined braking force and conveying the flexible printed wiring board material with the other nip drive roller pair.

The image forming apparatus of the present invention may also be configured as a device that forms image on a display-use board other than forming image on the flexible printed wiring board material 28 serving as the long, band-like flexible recording medium.

Also, the present invention is not limited to this and can take various other configurations in a range that does not depart from the gist of the invention.

According to the image forming apparatus of the present invention, there is the effect that exposure can be continuously conducted with respect to a long flexible recording medium to conduct many exposures within a unit time and improve productivity.

What is claimed is:

1. An image forming apparatus that forms images on a long flexible recording medium, the image forming apparatus comprising:

a belt conveyance mechanism that is disposed on a conveyance path and includes an endless belt wound between at least two rollers wherein the belt conveyance mechanism is movable, by a moving mechanism, along the conveyance direction of the flexible recording medium; and an image forming unit that conducts image forming on the long flexible recording medium being conveyed by the endless belt.

2. The image forming apparatus of claim 1, further comprising a suction mechanism disposed at a side of the endless belt opposite from the side of the endless belt on which the recording medium is placed.

3. The image forming apparatus of claim 2, wherein the endless belt includes through holes and the suction mechanism conducts sucking through the through holes, whereby the long flexible recording medium is sucked against the surface of the endless belt.

4. The image forming apparatus of claim 1, wherein the belt conveyance mechanism includes a support mechanism that is disposed at the side of the endless belt opposite from the side of the endless belt on which the recording medium is placed and which supports the underside of the endless belt.

5. The image forming apparatus of claim 4, wherein the support mechanism comprises a contact roller.

6. The image forming apparatus of claim 4, wherein the support mechanism comprises a suction stage including numerous suction-use holes.

7. The image forming apparatus of claim 1, further comprising an alignment unit, wherein the belt conveyance mechanism is movable to an alignment position at which an image forming position is corrected by the alignment unit and an image forming position resulting from the image forming unit.

8. The image forming apparatus of claim 7, wherein the belt conveyance mechanism includes a support mechanism that is disposed at a side of the endless belt opposite from the side of the endless belt on which the recording medium is placed and which supports the underside of the endless belt at a position facing the alignment unit via the endless belt.

9. The image forming apparatus of claim 7, wherein the belt conveyance mechanism includes a support mechanism that is disposed at a side of the endless belt opposite from the side of the endless belt on which the recording medium is placed and which supports the underside of the endless belt at a position facing the image forming unit via the endless belt.

10. The image forming apparatus of claim 7, wherein the endless belt comprises plural belts disposed at predetermined intervals apart from each other, and the alignment unit is disposed opposite from the image forming unit via the endless belt and detects, through gaps between the plural belts, an alignment mark formed on the undersurface of the flexible recording medium to conduct alignment.

11. The image forming apparatus of claim 1, wherein the image forming unit comprises a laser exposure device.

12. The image forming apparatus of claim 1, wherein the image forming unit is configured to modulate a light beam with a spatial light modulator and expose a two-dimensional pattern.

13. The image forming apparatus of claim 1, further comprising a contact roller that contacts and supports the underside of the endless belt of the belt conveyance mechanism, and a suction box disposed so as to cover the contact roller, wherein the endless belt includes through holes that are communicable with the suction box, and the flexible recording medium on the endless belt is sucked through the suction box and the through holes.

* * * * *